US006032429A

United States Patent [19]

Choi

[11] Patent Number: 6,032,429

[45] Date of Patent: Mar. 7, 2000

[54] DAMP-PROOF BRICK COVER

[76] Inventor: Jung Woong Choi, 551-33,8/2 Banpo-Dong, Seocho-ku, Seoul, Rep. of Korea

[21] Appl. No.: 08/771,665

[22] Filed: Dec. 23, 1996

[30] Foreign Application Priority Data

Dec. 27, 1995 [KR] Rep. of Korea ..... 95-49108
Apr. 13, 1996 [KR] Rep. of Korea ..... 96-7964

[51] Int. Cl.[7] ..... E04B 5/04

[52] U.S. Cl. ..... 52/612; 52/311.1

[58] Field of Search ..... 52/311.1, 3, 597, 52/598, 293.2, 169.5, 302.4, 302.3, 62, 58; 206/322

[56] References Cited

U.S. PATENT DOCUMENTS

| | | | |
|---|---|---|---|
| 1,814,968 | 7/1931 | Schario | 206/322 |
| 2,294,776 | 9/1942 | Freeman | 52/302.4 |
| 3,487,603 | 1/1970 | Roberts, Jr. | 206/322 X |
| 3,566,571 | 3/1971 | Stein | 52/598 |
| 4,831,802 | 5/1989 | Cromrich et al. | 52/311.1 X |

FOREIGN PATENT DOCUMENTS

| | | | |
|---|---|---|---|
| 1328162 | 7/1962 | France | 52/597 |

*Primary Examiner*—Creighton Smith
*Attorney, Agent, or Firm*—Rabin & Champagne P.C.

[57] ABSTRACT

A damp-proof insulation brick cover having an empty space at the bottom of the dampproof brick cover formed of rectangular hexahedrons, formed as a unit including a pair of side walls, a pair of longitudinal walls, and an upper panel part. At certain intervals, a plurality of protruding parts are formed under the whole upper panel, wherein an insulation space is formed between said upper panel and upper part of said brick when the brick is inserted into the inner space of the brick cover.

Slanted protrusions are installed between vertical protrusions at an upper part of both ends of the longitudinal walls of the brick covers, and a slanted protrusion is formed in one of said longitudinal walls, at the same height as the side wall slanted protrusion.

When applied to the bottom part of a protection wall, the floor of which has lots of water permeating from underground, the brick cover prevents capillary action of water in the walls.

7 Claims, 3 Drawing Sheets

DAMP-PROOF BRICK COVER

TECHNICAL FIELD

The present invention relates to water-proofing of underground cellar construction, and particularly to a damp-proof construction for underground cellar construction employing a damp-proof brick cover.

BACKGROUND OF THE INVENTION

Underground rooms are always dampened by the penetration of water through outer walls of the construction such that the penetrating water is collected on the bottom surface of the underground room.

Then, the stagnant water rises up the inner wall by capillary action of the wall to spread to all of the wall.

The moisture content of the wall produces must and is harmful to one's health.

SUMMARY OF THE INVENTION

The object of this invention is to provide a damp-proof method and assembly for underground cellar construction which is able to prevent capillary action of water in the walls and solve the above problem.

The present invention provides a damp-proof construction for underground cellars comprising:

damp proof brick covers formed of plastic disposed on the base surface of the underground cellar on the inside of the outer wall with space between adjacent bricks for drainage:

an inner wall of cement bricks is mounted on the damp-proof bricks.

Further, the present invention provides a damp-proof brick for water proofing of underground cellars.

The damp-proof brick of the present invention is formed of plastic materials and is applied to the under part of an inner wall on an underground room's bottom.

Additional objects and features of the present invention will be apparent from the following description, in which reference is made to the accompanying drawings.

DETAILED DESCRIPTION OF THE PREFERRED EMBODIMENT

Figure 1:
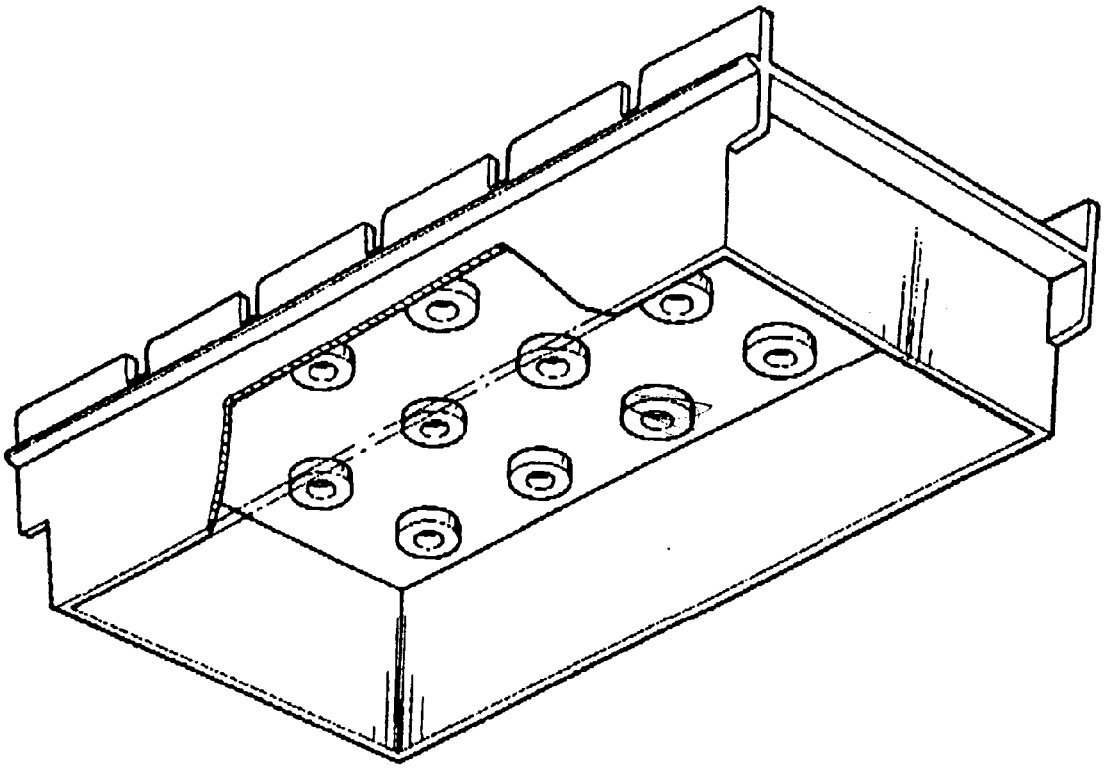
FIG. 1 is a perspective view of the damp-proof brick cover.

The present invention relates to a damp-proof brick cover for preventing capillary action of stagnated water collected on the bottom surface of a room and for preventing the moisture content of the walls from increasing.

The coldness of the underground passes on through an upper panel portion of said damp proof bricks and the protection wall becomes cooled at the bottom.

The inner part of the cooled protection wall contacts the underground air. When the underground air is warm and damp, the inner part of the protection wall is wet with dew due to the temperature differential. The dew drops caused by the dewy phenomenon make said protection wall always wet with moisture, which is harmful to one's health.

Therefore, there were attempts to prevent said capillary action by constructing a separate water proof layer in the bottom of a protection wall of an underground cellar. However, the perfect construction of a separate waterproof layer was so difficult that defects in the construction were frequently found.

To solve these problems, the applicant filed a utility model application in Korea and registered the damp-proof bricks (Registered No. 056316). Said damp-proof brick is a rectangular hexahedron and formed as a unit including a pair of side walls, a pair of longitudinal walls and an upper panel part. There is an empty space at the bottom of the damp-proof brick covers.

The construction of a protection wall using the damp-proof brick is simple. The damp-proof bricks, the inner part of which is filled with concrete, are laid down in one row at the bottom of the protection wall. On the upper part of the damp-proof bricks, the general bricks are continuously laid down the finally make to protection wall. Thus, in fact, capillary action is prevented in the protection wall and all of the walls constructed upon the damp-proof bricks are free from moisture and maintain pleasant conditions.

But, the coldness of underground passes on through the upper panel portion of said damp proof bricks and the protection wall becomes cooled from the bottom.

The inner part of the cooled protection wall contacts the underground air. When the underground air is warm and damp, the inner part of the protection wall becomes wet with dew due to the temperature differential. The dew drops caused by the dewy phenomenon make said protection wall always wet with moistures and are harmful to the health.

The object of this invention is to provide a damp-proof insulating brick cover which intercepts the passing of the underground cold wave that makes the protection wall cooled from the bottom.

The detailed description of the present invention is as follows: There is an empty space at the bottom of the dampproof brick cover in the shape of a rectangular hexahedron which is formed as a unit of a pair of side walls, a pair of longitudinal walls and an upper panel part.

The upper portion of a pair of said side walls and a pair of said longitudinal walls have hollow parts at certain intervals formed in a protection portion of the side walls and longitudinal walls, which are the same as the damp-proof bricks of the conventional invention.

As shown in FIG. 1, the damp-proof brick covers of the present invention consist of a plurality of protruding parts along a same length under the whole upper panel at certain intervals. Due to said protruding parts, an insulation space is formed between said upper panel and the upper part of said brick as the brick is inserted into the inner space of the brick cover.

In the upper part of the upper panel, there are a plurality of protrusions which prevent the upper bricks from sliding at the time of laying the bricks. Also, around the four sides of the panel, rising parts with grooves in a certain interval are formed.

Said protruding parts for making insulating space can be made in various shapes. But to minimize the transmission of the underground coolness through the damp proof brick cover to the protection wall and to endure the weight of the protection wall, the protruding parts should possibly have a round shape.

Said insulation space (12*a*) refers to the air layer formed between said under part of the upper panel (10) and the upper part of said brick when the brick is inserted into the damp-proof brick cover.

Figure 4:
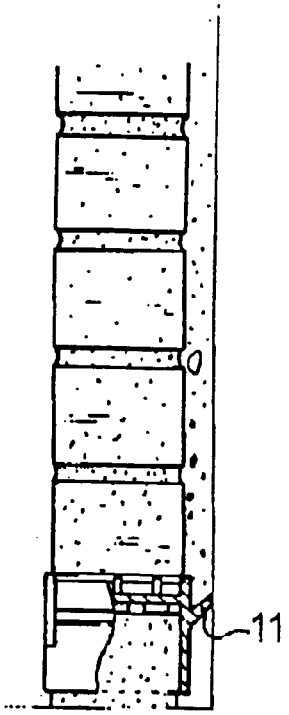
FIG. 4 is a use-state front view of FIG. 1.
Figure 5:
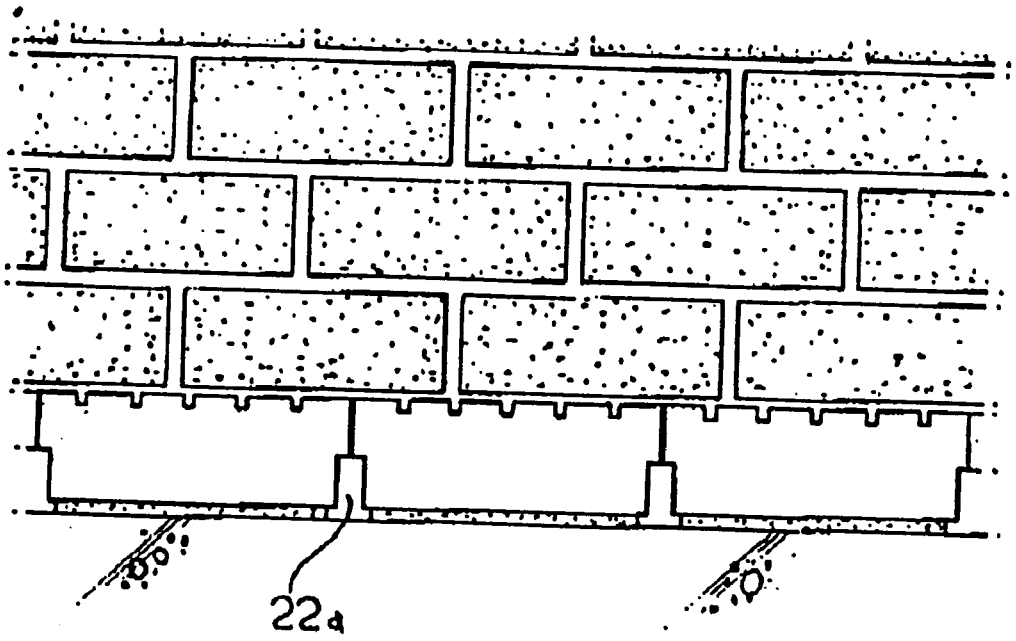
FIG. 5 is a use-state side view of FIG. 1.

The damp-proof brick cover of the present invention, as illustrated in FIG. 1 and FIG. 4, are laid in one row at the bottom of the protection wall with bricks inserted therein. Then the bricks are laid upon the upper part of the upper panel to form the protection wall.

The damp-proof brick cover thus laid effectively cuts off the underground coldness. It minimizes the temperature gap between the protection wall and the underground cellar and prevents the formation of dew in the protection wall due to the temperature gap, thus maintaining a pleasant environment, keeping the protection wall dry all the time.

Figure 2:
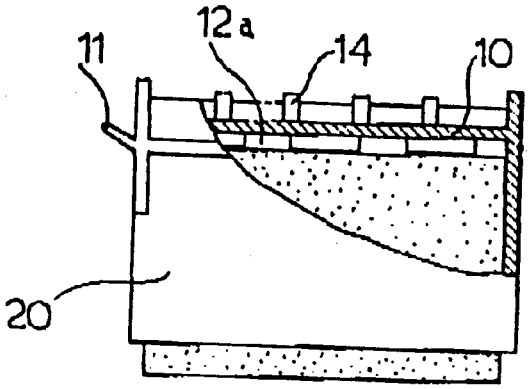
FIG. 2 is a partial sectional side view of FIG. 1.
Figure 3:
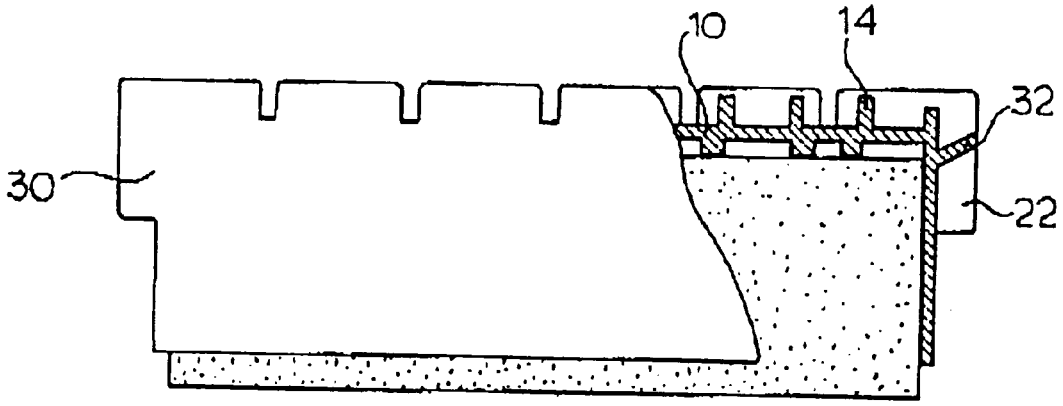
FIG. 3. is a partial sectional front view of FIG. 1.

The action and effects of the present invention are described in detail through example;

Firstly, as illustrated in FIG. 2 and FIG. 3, vertical protrusions (22) are installed at an upper part of both ends of a pair of side walls of the brick covers, forming drainage grooves **(22*a*) at the lower part. These vertically protruding panels (22)** facilitate the draining of stagnant water on the floor, because the drainage grooves are formed at the lower part of the damp-proof brick covers, which can be laid down attached to each other.

Secondly, as illustrated in FIG. 2 and FIG. 3 slanted protrusions (32) are located between said vertical protrusions at an upper part of both ends of longitudinal walls of the brick cover. Said slanted protrusions (32) keep the cement mortar applied on the damp-proof brick cover from flowing down to the drainage grooves **(22*a*)**, which would stop up the drainage groove. Therefore, the ancillary action is technically prevented by this composition.

Thirdly, the damp-proof insulated brick cover further comprises slanted protrusions (11) in one of said longitudinal walls (30), at the same height as the side wall slanted protrusions (32), across the whole length of the longitudinal walls (30), formed as a unit with said walls. The inner part is adjacent to said said longitudinal wall and the outer part is upwardly slanted.

Fourthly, as illustrated in FIG. 2 and FIG. 3, a plurality of adhesive protrusions (14) are installed in the whole area of the upper face of the upper panel (10) at certain intervals. These adhesive protrusions (14) are installed to solve a problem caused by the fact that said brick cover is made of a synthetic resin which is very resistant to adhering to the cement mortar, and that the upper face of the upper panel is always flat. To strengthen the binding force between the cement mortar and the upper face of the upper panel of the brick cover, the plurality of adhesive protrusions (14) are installed in the whole area of the upper face of the upper panel (10).

As described above, the present invention relates to the bottom part of a protection wall, the floor of which has lots of water permeating from underground, which prevents capillary action of the water in the walls. Also, in applying the present invention to the underground cellar, one not only is able to get rid of the dewy phenomenon of the wall caused by the temperature differential between the underground air and the protection wall, by preventing the underground coolness, but one also lays the general bricks attached at the same time to the damp-proof brick covers of the present invention. Also, the present invention is useful in preventing the stopping up of the drainage grooves.

We claim:

1. A damp-proof insulation brick cover, shaped as a hollow hexahedron comprising a pair of opposing side walls, a pair of opposing longitudinal walls, an upper panel, and an open bottom, wherein the upper panel includes a plurality of protruding parts facing the open bottom, such that, when the brick cover is placed over a brick, the protruding parts rest on the brick, leaving an insulating space between the brick and the upper panel, wherein the longitudinal walls include projections at a top portion thereof, projecting from ends of the longitudinal walls parallel to the longitudinal walls and projecting in a substantially perpendicular direction from the side walls, so that drainage grooves are formed below the projections.

2. The brick cover of claim 1, wherein the side walls include slanted protrusions formed along an upper portion of the side walls between the projections.

3. The brick cover of claim 1, wherein one of the longitudinal walls includes a slanted protrusion formed along an entire upper portion of the longitudinal wall, between the projections and at a height substantially the same as a height of the projections, wherein the slanted protrusion slants upward and outward from the longitudinal wall.

4. A damp-proof insulation brick cover, shaped as a hollow hexahedron comprising a pair of opposing side walls, a pair of opposing longitudinal walls, an upper panel, and an open bottom, wherein the upper panel includes a plurality of protruding parts facing the open bottom, such that, when the brick cover is placed over a brick, the protruding parts rest on the brick, leaving an insulating space between the brick and the upper panel, wherein the side walls include slanted protrusions formed along an upper portion of the side walls.

5. A damp-proof insulation brick cover, shaped as a hollow hexahedron comprising a pair of opposing side walls, a pair of opposing longitudinal walls, an upper panel, and an open bottom, wherein the upper panel includes a plurality of protruding parts facing the open bottom, such that, when the brick cover is placed over a brick, the protruding parts rest on the brick, leaving an insulating space between the brick and the upper panel, wherein one of the longitudinal walls includes a slanted protrusion formed along an entire upper portion of the longitudinal wall, wherein the slanted protrusion slants upward and outward from the longitudinal wall.

6. A damp-proof insulation brick cover, shaped as a hollow hexahedron comprising a pair of opposing side walls, a pair of opposing longitudinal walls, an upper panel, and an open bottom, wherein the upper panel includes a plurality of protruding parts facing the open bottom, such that, when the brick cover is placed over a brick, the protruding parts rest on the brick, leaving an insulating space between the brick and the upper panel, further comprising adhesive protrusions attached to an upper surface of the upper panel.

7. The brick cover of claim 6, wherein the adhesive protrusions are attached at certain intervals over the entire upper surface of the upper panel.

* * * * *